US007339538B2

(12) United States Patent
Yoneya et al.

(10) Patent No.: US 7,339,538 B2
(45) Date of Patent: Mar. 4, 2008

(54) EASY-TO-ASSEMBLE ANTENNA UNIT

(75) Inventors: Akira Yoneya, Akita (JP); Yoshiaki Imano, Akita (JP); Kazunari Saito, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 92 days.

(21) Appl. No.: 11/322,196

(22) Filed: Dec. 29, 2005

(65) Prior Publication Data

US 2006/0197710 A1 Sep. 7, 2006

(30) Foreign Application Priority Data

Mar. 1, 2005 (JP) ..... 2005-055390

(51) Int. Cl.
*H01Q 1/32* (2006.01)
*H01Q 1/42* (2006.01)

(52) U.S. Cl. ..... 343/713; 343/711; 343/872

(58) Field of Classification Search ..... 343/872, 343/711, 713

See application file for complete search history.

(56) References Cited

U.S. PATENT DOCUMENTS 6,679,666 B2 * 1/2004 Mizuno et al. ..... 411/353

6,930,643 B2 * 8/2005 Byrne et al. ..... 343/702

FOREIGN PATENT DOCUMENTS

JP 2001-68912 A 3/2001

* cited by examiner

*Primary Examiner*—Hoang V. Nguyen
*Assistant Examiner*—Robert Karacsony
(74) *Attorney, Agent, or Firm*—Frishauf, Holtz, Goodman & Chick, P.C.

(57) ABSTRACT

An antenna unit according to the present invention comprises an antenna case composed of a top cover and a bottom plate that are joined together. An antenna module is disposed in the top cover. A packing member is disposed at a joining portion between the top cover and the bottom plate to thereby ensure sealing of the antenna module. The packing member has a plurality of anti-slip projecting portions, while the bottom plate has a plurality of through holes receiving the plurality of projecting portions so as to pass therethrough. A diameter of the through hole is made greater than that of the projecting portion to thereby provide a clearance between the through hole and the projecting portion.

3 Claims, 7 Drawing Sheets

EASY-TO-ASSEMBLE ANTENNA UNIT

This application claims priority to prior Japanese patent application JP 2005-55390, the disclosure of which is incorporated herein by reference.

BACKGROUND OF THE INVENTION

This invention relates to an antenna unit for receiving GPS signals transmitted from GPS satellites and, in particular, relates to an anti-slip structure thereof.

In recent years, the so-called global positioning system has been spreading in which a receiver receives signal waves transmitted respectively from a plurality of artificial satellites orbiting the earth and the current position of the receiver itself is detected based on information included in the received signal waves. This system is generally called a GPS (Global Positioning System) in those countries such as Japan and USA. The GPS generally uses GPS satellites controlled by the US Department of Defense. As similar systems, there are "GALILEO" used in Europe and "GLONASS" used in Russia. Herein, a positioning system using artificial satellites, the artificial satellites used in the positioning system, signal waves transmitted from the artificial satellites, receivers for receiving the signal waves, and so on are referred to as a GPS, GPS satellites, GPS signals, GPS receivers, and so on, respectively, for convenience sake.

The GPS is capable of detecting a current position of a GPS receiver itself with high accuracy and substantially in real time. Accordingly, the GPS is mainly used such that a GPS receiver is mounted in a moving object such as an automobile, an airplane, or a portable telephone and the current position of the moving object is measured.

Presently, GPS receivers that are suitable when installed in automobiles, i.e. so-called car GPS receivers, are rapidly spreading. When installing the GPS receiver in the automobile, a GPS receiving antenna unit for receiving GPS signals is disposed outside the automobile, for example, on a roof. Such a GPS receiving antenna unit is disclosed, for example, in Japanese Unexamined Patent Application Publication (JP-A) No. 2001-68912.

Referring to FIG. 1, a conventional antenna unit 100 will be described hereinbelow. The antenna unit 100 comprises an antenna case 103, an antenna module 104, a rubber packing member 105, and a signal line 106. The antenna case 103 is composed of a domed top cover 101 and a bottom plate 102 that are joined together. The antenna module 104 is disposed in the top cover 101. The packing member 105 is disposed at a joining portion between the top cover 101 and the bottom plate 102 to thereby ensure watertightness of the antenna case 103. The signal line 106 is connected to the antenna module 104.

The antenna module 104 comprises an antenna element 110 and a circuit board 111. The antenna element 110 is formed with an antenna for receiving GPS signals transmitted from GPS satellites. The circuit board 111 is formed with a circuit (hereinafter referred to as a "signal processing circuit") adapted to perform various signal processing such as signal amplification with respect to a GPS signal received by the antenna element 110. The antenna element 110 and the circuit board 111 are bonded together by the use of a double-sided adhesive tape 112 or the like.

The signal line 106 is connected to the circuit board 111 for outputting the GPS signal to the outside of the antenna case 103. Further, a shield case 114 for shielding the signal processing circuit is attached to the circuit board 111 at its main surface on the side opposite to the side where the antenna element 110 is disposed. The signal line 106 is drawn out to the outside through a cutout portion 101*a* formed at the top cover 101. A gasket 115 is attached at a position corresponding to the cutout portion 101*a*.

The antenna unit 100 is assembled by fixing the top cover 101 and the bottom plate 102 together by the use of four screws 120 in the state where the antenna module 104 and the packing member 105 are disposed in an inner space of the top cover 101.

The bottom plate 102 is formed with two concave portions 102*a* (only one of them is illustrated in FIG. 1). Permanent magnets (not shown) are disposed in the concave portions 102*a*, respectively. These permanent magnets are used for fixing by attraction the antenna unit 100 to a roof of an automobile. Further, a name plate 121 in the form of an aluminum thin plate indicating a type number, a name, etc. of the antenna unit 100 is disposed on a main surface of the bottom plate 102 on its side exposed outward. For the purpose of preventing damage to the roof of the automobile, a transparent resin sheet 122 is stuck to the main surface of the bottom plate 102 so as to cover the name plate 121 and substantially the whole of the main surface of the bottom plate 102.

As shown in FIG. 2, four projecting portions (legs) 105*a* are provided at a lower surface of the packing member 105. These projecting portions 105*a* pass through the bottom plate 102 and the resin sheet 122 so as to be exposed from a bottom surface of the antenna body. These projecting portions 105*a* serve to prevent slippage of the antenna body when it is placed on the roof of the automobile.

On the other hand, as shown in FIG. 3, the bottom plate 102 is formed with four through holes 102*b* for press-fitting the four projecting portions 105*a* therethrough. The diameter of each through hole 102*b* is substantially equal to that of each projecting portion 105*a*. The length of each projecting portion 105*a* is relatively long.

Therefore, as shown in FIG. 4, the packing member 105 is fixed to the bottom plate 102 by press-fitting the projecting portions 105*a* of the packing member 105 into the through holes 102*b* of the bottom plate 102.

As described above, in the conventional antenna unit 100, the packing member 105 is fixed to the bottom plate 102 by press-fitting the rubber legs 105*a* of the packing member 105 into the through holes 102*b* of the bottom plate 102. Therefore, in the conventional antenna unit 100, there is a problem that since each rubber leg 105*a* is relatively long and the diameters of each through hole 102*b* of the bottom plate 102 and each rubber leg 105*a* are substantially equal to each other, the operation performance is poor when press-fitting the soft rubber legs 105*a* into the through holes 102*b* of the bottom plate 102.

SUMMARY OF THE INVENTION

It is therefore an object of this invention to provide an antenna unit that is excellent in assembly performance when assembling the antenna unit.

An antenna unit according to the present invention comprises an antenna case composed of a top cover and a bottom plate that are joined together. An antenna module is disposed in the top cover and adapted to receive a radiowave. A packing member is disposed at a joining portion between the top cover and the bottom plate to thereby ensure sealing of the antenna module. The packing member has a plurality of anti-slip projecting portions, while the bottom plate has a plurality of through holes receiving the plurality of projecting portions so as to pass therethrough.

According to an aspect of the present invention, a diameter of each of the through holes is made greater than that of each of the projecting portions to thereby provide a clearance between the through hole and the projecting portion.

In the antenna unit according to the asepect, it is preferable that each of the projecting portions has a length such that the projecting portion does not abut an edge of the through hole in the state where the projecting portion is elastically deformed laterally.

In the antenna unit according to the aspect, it is preferable that each of the projecting portions has a tip portion having a round shape.

In the antenna unit according to the aspect, it is preferable that the antenna unit is adapted to receive a GPS signal as the radiowave.

BRIEF DESCRIPTION OF THE DRAWINGS

FIGS. 6A to 6G are diagrams showing a packing member used in the antenna unit illustrated in FIG. 5, wherein FIG. 6A is a plan view of the packing member, FIG. 6B is a front view of the packing member, FIG. 6C is a right side view of the packing member, FIG. 6D is a rear view of the packing member, FIG. 6E is a bottom view of the packing member, FIG. 6F is a sectional view taken along line A-A in FIG. 6A, and FIG. 6G is a sectional view taken along line B-B in FIG. 6A;

FIGS. 7A to 7D are diagrams showing a bottom plate used in the antenna unit illustrated in FIG. 5, wherein FIG. 7A is a bottom view of the bottom plate, FIG. 7B is a front view of the bottom plate, FIG. 7C is a side view of the bottom plate, and FIG. 7D is a sectional view taken along line A-A in FIG. 7A.

DESCRIPTION OF THE PREFERRED EMBODIMENTS

Figure 1:
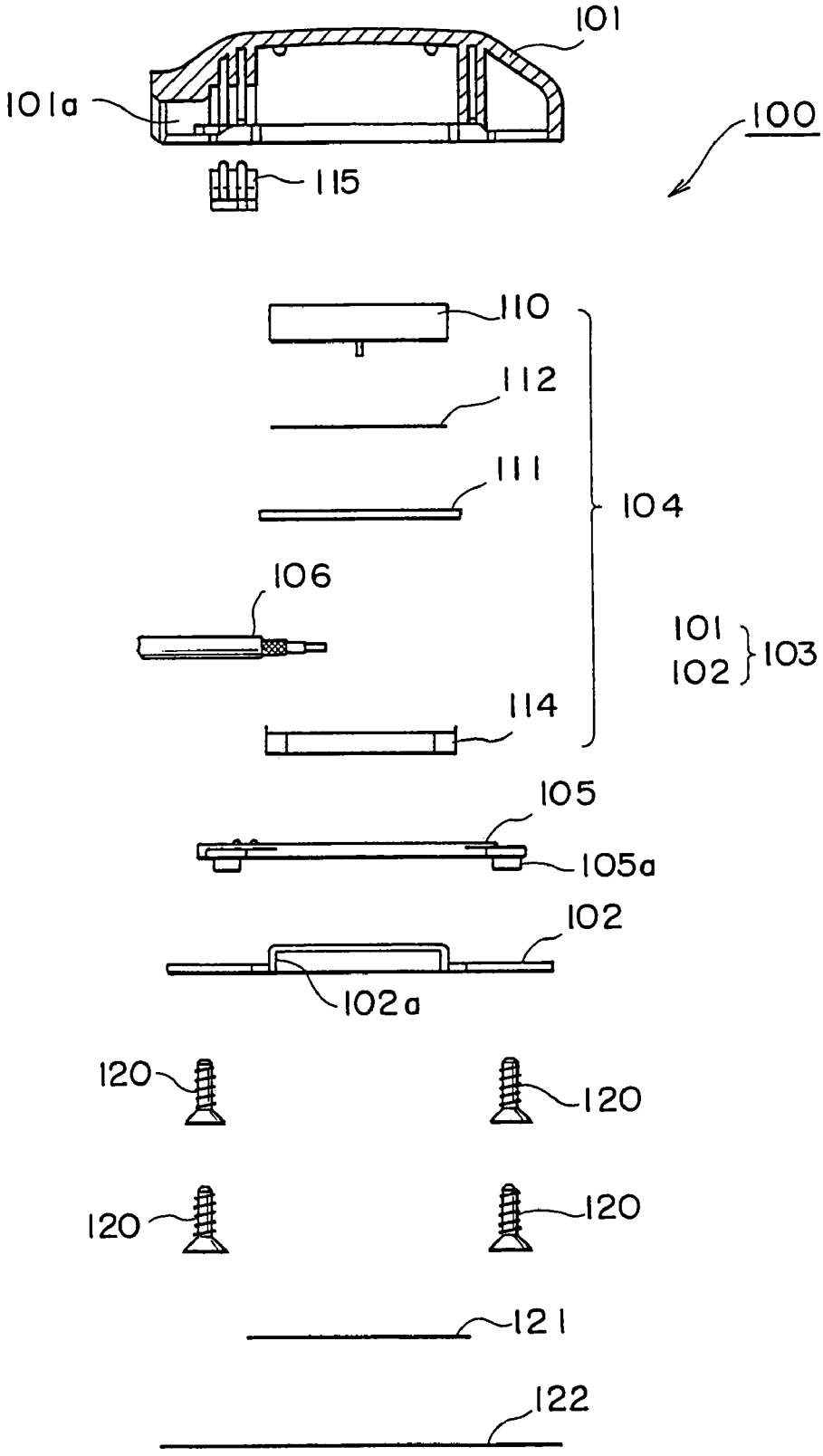
FIG. 1 PRIOR ART
FIG. 1 is a schematic exploded diagram showing one example of a conventional antenna unit.
Figure 2:
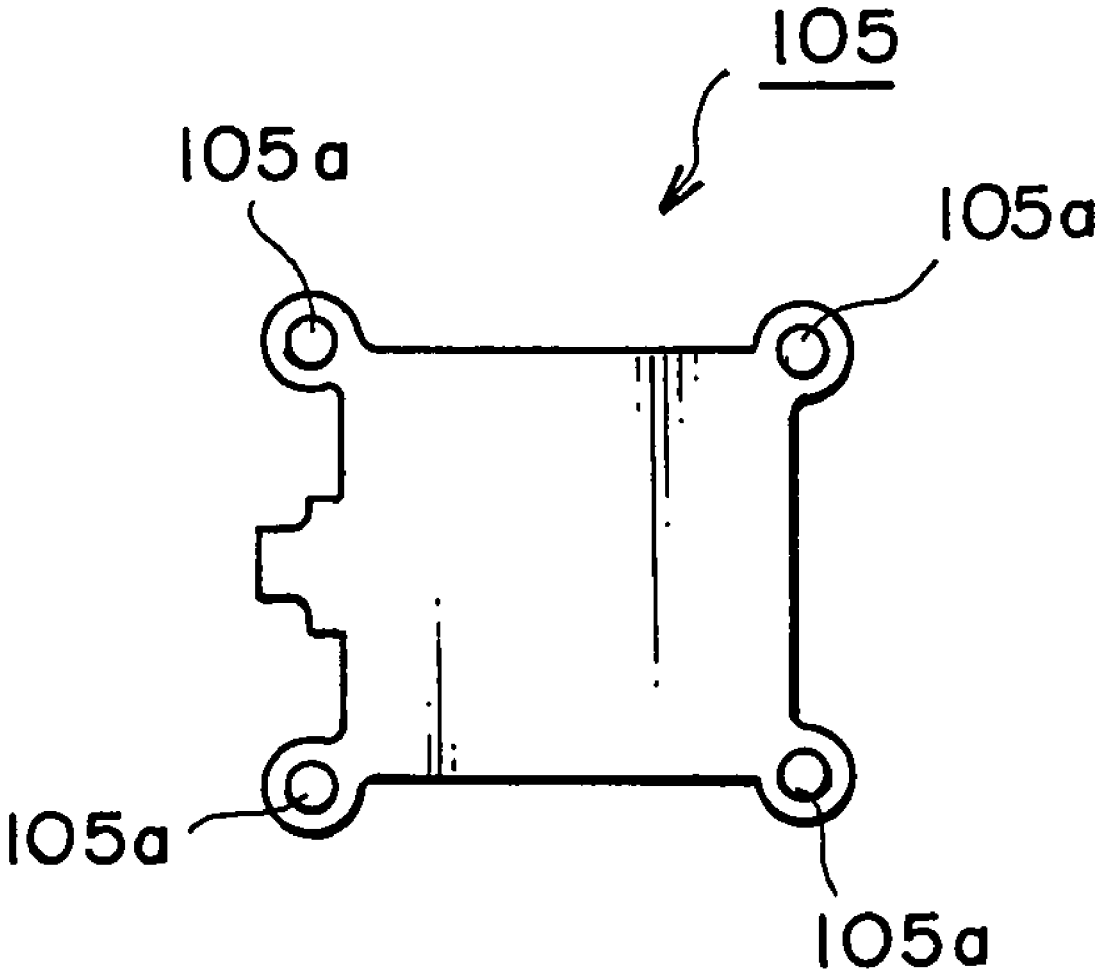
FIG. 2 PRIOR ART
FIG. 2 is a bottom view showing a packing member used in the antenna unit illustrated in FIG. 1.
Figure 3:
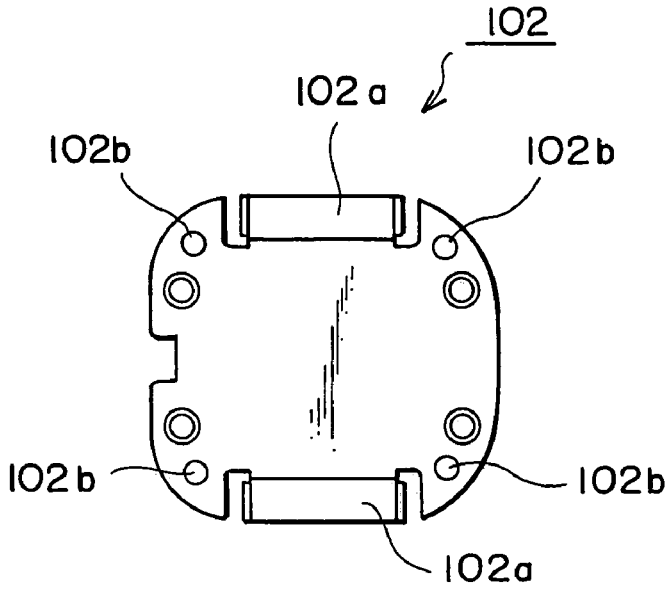
FIG. 3 PRIOR ART
FIG. 3 is a bottom view showing a bottom plate used in the antenna unit illustrated in FIG. 1.
Figure 4:
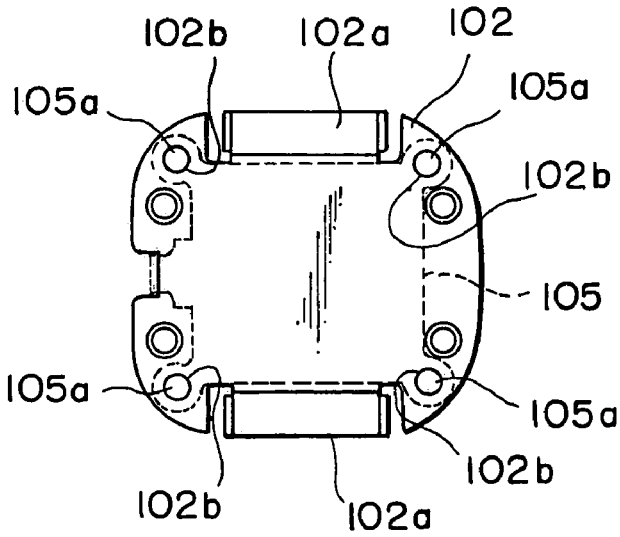
FIG. 4 PRIOR ART
FIG. 4 is a bottom view showing the state where the packing member illustrated in FIG. 2 is fixed to the bottom plate illustrated in FIG. 3.
Figure 5:
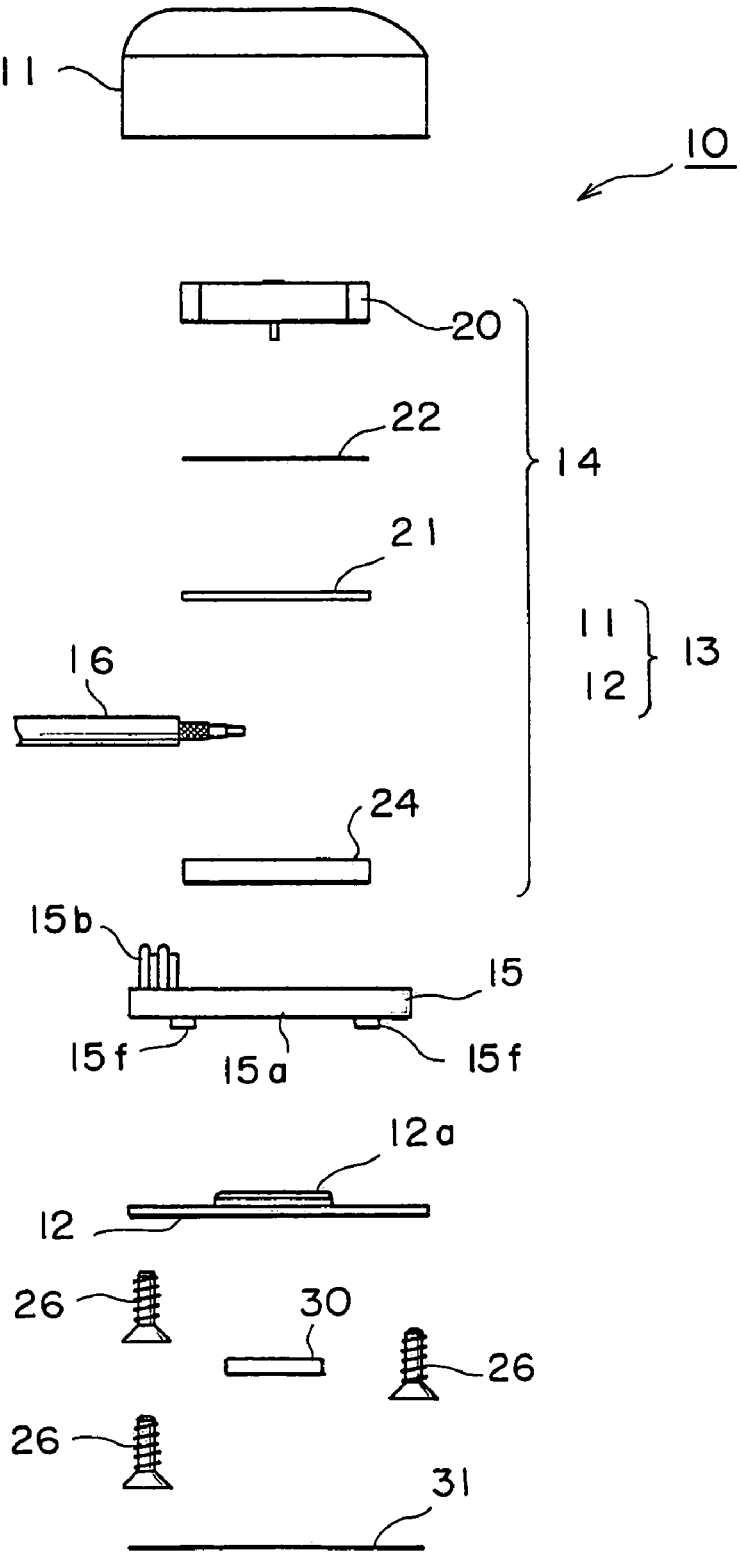
FIG. 5 is a schematic exploded diagram showing an antenna unit according to an embodiment of this invention.

Referring to FIG. 5, description will be made about an antenna unit 10 according to an embodiment of this invention. The shown antenna unit 10 is an antenna unit for GPS signal reception.

The antenna unit 10 comprises an antenna case 13, an antenna module 14, a packing member 15, and a signal line 16. The antenna case 13 is composed of a domed top cover 11 and a bottom plate 12 that are joined together. The antenna module 14 is disposed in the top cover 11. The packing member 15 is disposed at a joining portion between the top cover 11 and the bottom plate 12 to thereby ensure watertightness of the antenna case 13. Since the packing member 15 serves to provide a waterproof function, it is also called a waterproof packing. The signal line 16 is connected to the antenna module 14.

The antenna module 14 comprises an antenna element 20 and a circuit board 21. The antenna element 20 is formed with an antenna for receiving GPS signals transmitted from GPS satellites. The circuit board 21 is formed with a circuit (hereinafter referred to as a "signal processing circuit") adapted to perform various signal processing such as signal amplification with respect to a GPS signal received by the antenna element 20. The antenna element 20 and the circuit board 21 are bonded together by the use of a double-sided adhesive tape 22 or the like.

The signal line 16 is connected to the circuit board 21 for outputting the GPS signal to the outside of the antenna case 13. Further, a shield case 24 for shielding the signal processing circuit is attached to the circuit board 21 at its main surface on the side opposite to the side where the antenna element 20 is disposed. The signal line 16 is drawn out to the outside through a cutout portion (not shown) formed at the top cover 11.

The antenna unit 10 is assembled by fixing the top cover 11 and the bottom plate 12 together by the use of three screws 26 in the state where the antenna module 14 and the packing member 15 are disposed in an inner space of the top cover 11.

The packing member 15 is made of a resin material such as a silicone rubber. The packing member 15 comprises a base portion 15*a* covering the whole surface of the antenna module 14, and a gasket portion 15*b* covering the outer periphery of the signal line 16 at a position of the cutout portion formed at the top cover 11.

Figure 6E:
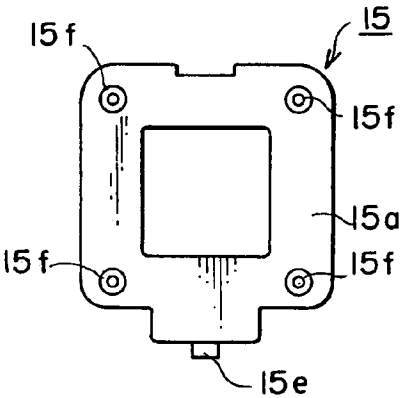
Figure 6C:
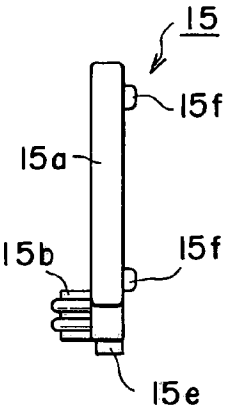
Figure 6D:
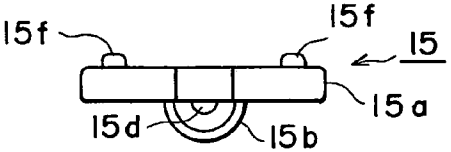
Figure 6A:
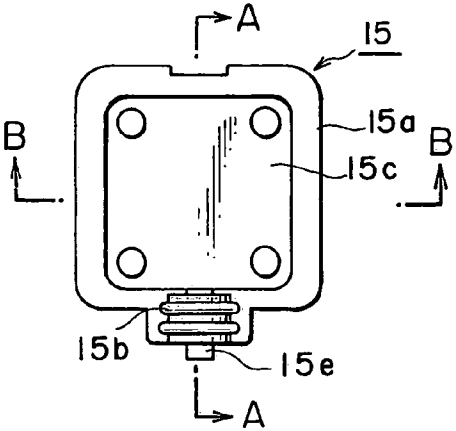
Figure 6B:
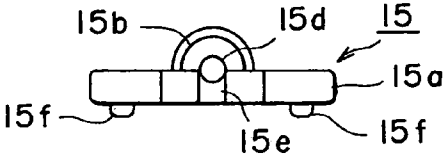
Figure 6G:
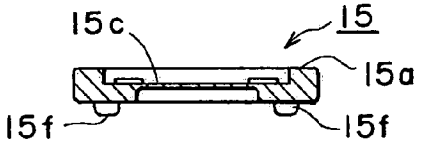
Figure 6F:
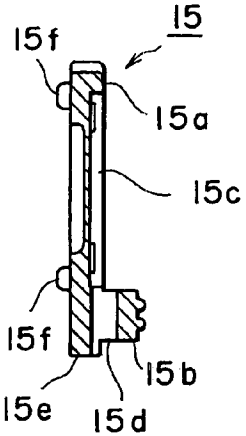

Referring to FIGS. 6A to 6G, the structure of the packing member 15 will be described in further detail. FIG. 6A is a plan view of the packing member 15, FIG. 6B is a front view of the packing member 15, FIG. 6C is a right side view of the packing member 15, FIG. 6D is a rear view of the packing member 15, FIG. 6E is a bottom view of the packing member 15, FIG. 6F is a sectional view taken along line A-A in FIG. 6A, and FIG. 6G is a sectional view taken along line B-B in FIG. 6A.

The base portion 15*a* has a concave portion 15*c*. Positioning of the antenna module 14 is carried out by the concave portion 15*c*. The concave portion 15*c* has a shape that covers substantially the whole bottom surface of the antenna module 14.

The packing member 15 is held between the top cover 11 and the bottom plate 12 when the top cover 11 and the bottom plate 12 are joined together. The packing member 15 is disposed for the purpose of ensuring watertightness at the joining portion between the top cover 11 and the bottom plate 12. The gasket portion 15*b* is formed so as to rise from the base portion 15*a* at the position corresponding to the cutout portion (not shown) of the top cover 11. The gasket portion 15*b* has a hole 15*d* at its center portion for insertion of the signal line 16 therethrough.

The packing member 15 has a convex portion 15*e* extending outward from the lower side of the hole 15*d*. The convex portion 15*e* contacts the lower side of the signal line 16 to thereby form a waterproof structure. The convex portion 15*e* is provided so as to be exposed to the outside from the cutout portion (not shown) of the top cover 11, thereby forming part of the surface of the antenna body. The packing member 15 further comprises four projecting portions (legs) 15*f* provided at the lower surface of the base portion 15*a*. These projecting portions 15*f* pass through the bottom plate 12 and a resin sheet 31 so as to be exposed from the bottom surface of the antenna body. These projecting portions 15*f* serve to prevent slippage of the antenna body when it is placed on a roof of an automobile.

Figure 7A:
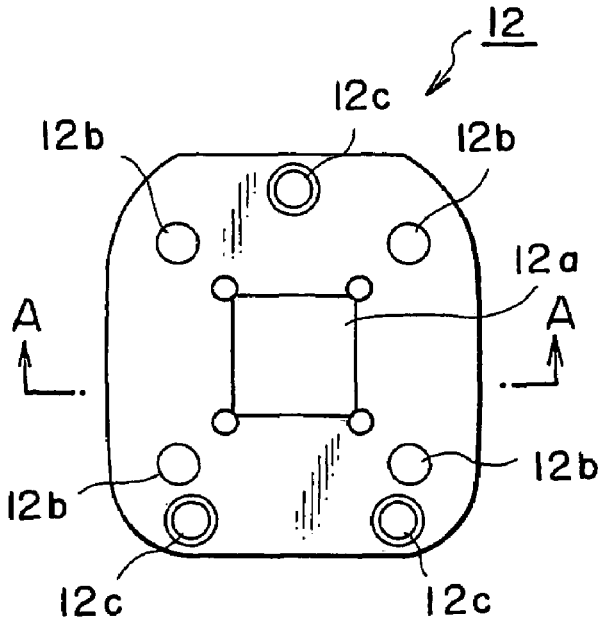
Figure 7C:
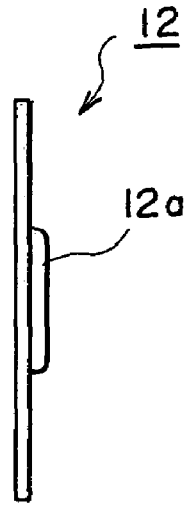
Figure 7B:
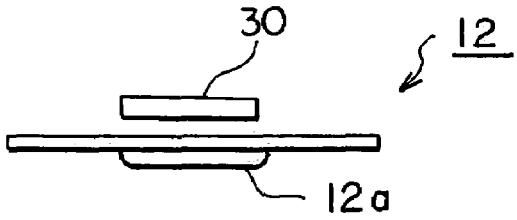
Figure 7D:
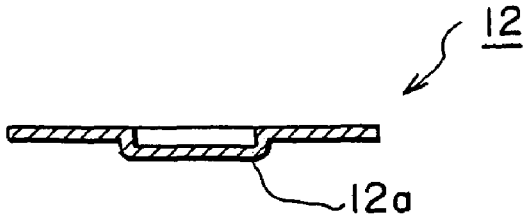

Referring to FIGS. 7A to 7D, the structure of the bottom plate 12 will be described. FIG. 7A is a bottom view of the bottom plate 12, FIG. 7B is a front view of the bottom plate 12, FIG. 7C is a side view of the bottom plate 12, and FIG. 7D is a sectional view taken along line A-A in FIG. 7A.

The bottom plate 12 is formed with a single concave portion 12*a* at its center portion. A permanent magnet 30 is disposed in the concave portion 12*a*. The permanent magnet 30 is used for fixing by attraction the antenna unit 10 to the roof of the automobile. The bottom plate 12 is formed with four through holes 12*b* for allowing the four projecting portions 15*f* of the packing member 15 to pass therethrough. The bottom plate 12 is further formed with three holes 12*c* for insertion of the three screws 26 therethrough.

As shown in FIG. 5, for the purpose of preventing damage to the roof of the automobile, the resin sheet 31 is stuck to a main surface of the bottom plate 12 on its side exposed outward so as to cover substantially the whole of the main surface of the bottom plate 12. A type number, a name, etc. of the antenna unit 10 are printed on the resin sheet 31.

Figure 8:
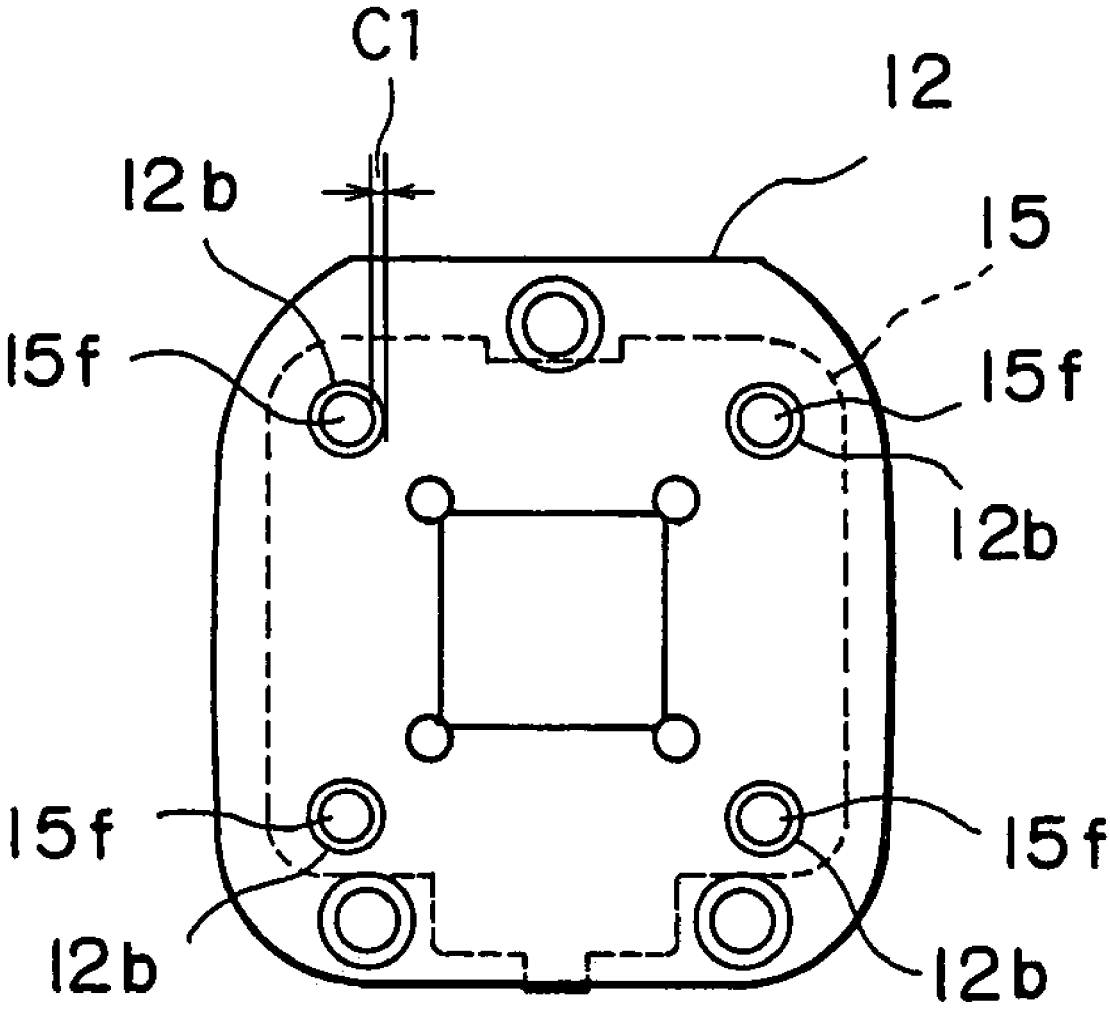
FIG. 8 is a bottom view showing the state where the packing member illustrated in FIGS. 6A to 6G and the bottom plate illustrated in FIGS. 7A to 7D are combined together.

FIG. 8 shows the state where the bottom plate 12 and the packing member 15 are combined together. As seen from FIG. 8, the diameter of each through hole 12*b* of the bottom plate 12 is greater than that of each projecting portion 15*f* of the packing member 15. That is, a clearance C1 is provided between the through hole 12*b* and the projecting portion 15*f*.

Further, the length of each projecting portion 15*f* is shortened to a degree such that even if the projecting portion 15*f* is elastically deformed laterally, the projecting portion 15*f* does not abut the edge of the through hole 12*b*. Further, as shown in FIG. 6B, the tip portion of each projecting portion 15*f* is R-shaped (rounded).

With the structure as described above, even if the projecting portion 15*f* is elastically deformed laterally, the projecting portion 15*f* escapes into the through hole 12*b* of the bottom plate 12 without abutting the edge of the through hole 12*b* of the bottom plate 12 and, therefore, the operation performance in antenna assembly is improved.

The present inventors have confirmed by tests that there is no influence on the anti-slip effect.

While this invention has been described in terms of the preferred embodiment, the invention is of course not limited thereto. The antenna unit described in the embodiment is suitable as an antenna unit for GPS signal reception, but not limited thereto, and is also applicable as an antenna unit for mobile communication adapted to receive other satellite waves, ground waves, or other radiowaves.

In the antenna unit according to this invention, since the diameter of each through hole formed in the bottom plate is set greater than that of each projecting portion of the packing member, the effect is obtained that the assembly performance is excellent when assembling the antenna unit.

What is claimed is:

1. An antenna unit comprising:

an antenna case comprising a top cover and a bottom plate that are joined together;

an antenna module disposed in said top cover and adapted to receive a radiowave; and a packing member disposed at a joining portion between said top cover and said bottom plate to thereby ensure sealing of said antenna module, wherein said packing member comprises a plurality of anti-slip projecting portions, wherein said bottom plate has a plurality of through holes which receive said plurality of projecting portions, respectively, so that the projecting portions pass therethrough, wherein a diameter of each of said through holes is greater than a diameter of each of said projecting portions to thereby provide a clearance between each through hole and the projecting portion passing therethrough, and wherein each of said projecting portions has a length such that any projecting portion in a state in which the projecting portion is elastically deformed laterally does not abut an edge of the through hole through which the laterally elastically deformed projecting portion passes.

2. An antenna unit according to claim 1, wherein each of said projecting portions has a tip portion having a round shape.

3. An antenna unit according to claim 2, wherein said antenna unit is adapted to receive a GPS signal as the radiowave.

* * * * *